US005616440A

United States Patent [19]

Takahashi et al.

[11] Patent Number: 5,616,440

[45] Date of Patent: Apr. 1, 1997

[54] PHOTOSENSITIVE MEMBER, ELECTROPHOTOGRAPHIC APPARATUS USING THE PHOTOSENSITIVE MEMBER, AND PROCESS FOR PRODUCING THE PHOTOSENSITIVE MEMBER

[75] Inventors: Toru Takahashi; Tsuneo Watanuki; Fumio Takei; Norio Sawatari; Yasushige Nakamura, all of Kawasaki, Japan

[73] Assignee: Fujitsu, Ltd., Kanagawa, Japan

[21] Appl. No.: 411,850

[22] Filed: Mar. 28, 1995

Related U.S. Application Data

[63] Continuation of Ser. No. 186,605, Jan. 26, 1994, abandoned.

[30] Foreign Application Priority Data

Mar. 18, 1993 [JP] Japan ..... 5-059057

[51] Int. Cl.[6] ..... G03G 5/10

[52] U.S. Cl. ..... 430/63; 430/131; 399/159

[58] Field of Search ..... 430/63, 62, 131; 525/100; 355/211

[56] References Cited

U.S. PATENT DOCUMENTS

| | | | |
|---|---|---|---|
| 4,025,691 | 5/1977 | Trevoy | 428/411 |
| 4,246,143 | 1/1981 | Sonoda et al. | 252/518 |
| 5,126,405 | 6/1992 | Jones et al. | 525/100 |
| 5,259,992 | 11/1993 | Bennett | 430/63 |
| 5,320,922 | 6/1994 | Mayama et al. | 430/63 |

FOREIGN PATENT DOCUMENTS

| | | |
|---|---|---|
| 0017717 | 10/1980 | European Pat. Off. . |
| 0435633 | 7/1991 | European Pat. Off. . |
| 63-174072 | 7/1988 | Japan . |
| 2075365 | 11/1981 | United Kingdom . |
| 92/07897 | 5/1992 | WIPO . |

OTHER PUBLICATIONS

*Patent Abstracts of Japan,* vol. 12, No. 280 (P–739) Aug. 2, 1988 & JP–A–63 061 254 (Ricoh Co., Ltd.) Mar. 17, 1988.

Tarumi, "Production of Electrophotographic Sensitive Body," *Patent Abstracts of Japan,* vol. 12, No. 280 (P–739), Aug. 2, 1988 & JP–A–63 061254 (Ricoh Co., Ltd.) Mar 17, 1988.

Sumino, "Manufacture of Electrophotographic Sensitive Body," *Patent Abstracts of Japan,* vol. 15, No. 220 (P–1211), Jun. 5, 1991 & JP–A–33 063654 (Canon Inc. ) Mar. 19, 1991.

*Primary Examiner*—John Goodrow

*Attorney, Agent, or Firm*—Staas & Halsey

[57] ABSTRACT

A photosensitive member including a transparent substrate, a transparent conductor layer formed on the transparent substrate and a photosensitive layer formed on the transparent conductor layer. An electrophotographic recording apparatus comprises the photosensitive member, voltage application means for uniformly charging electrically a surface of the photosensitive member, exposure means for effecting exposure from the back of the photosensitive member and forming an electrostatic latent image on the photosensitive member, development means for developing the electrostatic latent image to a toner image, and transfer means for transferring the toner image to recording paper.

19 Claims, 7 Drawing Sheets

43
45
44

43
45
46

PHOTOSENSITIVE MEMBER, ELECTROPHOTOGRAPHIC APPARATUS USING THE PHOTOSENSITIVE MEMBER, AND PROCESS FOR PRODUCING THE PHOTOSENSITIVE MEMBER

This application is a continuation of U.S. application Ser. No. 08/186,605, filed Jan. 26, 1994, now abandoned.

BACKGROUND OF THE INVENTION

1. Field of the Invention

This invention relates to an electrophotographic recording apparatus. More particularly, the present invention relates to an apparatus for effecting electrophotographic recording by using an electrophotographic photosensitive member, including a transparent conductor layer formed on a transparent substrate and a photosensitive layer formed on the transparent conductor layer, and by effecting exposure from the back of the photosensitive member.

2. Description of the Related Art

Existing copying machines and high-speed, high-quality printers generally use an electrophotographic recording system. This system employs a so-called "Carlson process" which uses a photosensitive member as a recording medium and effects recording through seven steps of uniform charging, image exposure, development, transfer, fixation, charge elimination and cleaning. In the charging step, a positive or negative uniform charge is applied to a surface of a photosensitive member having photoelectric conductivity and in the subsequent exposure process, a laser beam, etc., is shone onto the surface so as to eliminate a surface charge at a specific portion, thereby forming an electrostatic latent image, corresponding to the image information, on the photosensitive member. Next, this latent image is electrostatically developed to form a visible image, using a toner, on the photosensitive member. Finally, this toner image is electrostatically transferred to recording paper, and is fused by heat, light, pressure, etc., to obtain a printed matter. In the conventional recording apparatuses using this Carlson process, however, the means used for each process step are disposed around the photosensitive member. Therefore, when the size of the apparatus is reduced, these means are disposed more closely to one another around the photosensitive member. Accordingly, there is a limit to the reduction of the size of the recording system, and problems occur, that the developer scatters from the developing machine, contaminates the optical system used for image exposure means, and exerts adverse influences on printing.

In view of the problems described above, a proposal has been made to dispose an image exposure source inside the photosensitive member used in the image exposure process, and to effect light irradiation from the back of the photosensitive member (e.g. Japanese Unexamined Patent Publication (Kokai) No. 63-174072, etc.). When the image exposure source is disposed inside the photosensitive member, it becomes possible to reduce the size of the apparatus and to eliminate contamination of the optical system by the scattered developer. An LED array optical system, a laser optical system, and EL optical system, a liquid crystal shutter optical system, and so forth, can be used as the image exposure means. In order to accomplish the apparatus described above, a photosensitive member for back exposure, which has the same printing characteristics as a member which can be exposed from the outside as has been used in the prior art apparatuses, becomes necessary. The photosensitive member is normally produced by sequentially laminating conductor layers connected to the ground and photosensitive layers on a support, but the photosensitive member for back exposure must be able to transmit the rays of light irradiated from the back thereof to the photosensitive layers. To satisfy this requirement, a photosensitive member is necessary in which transparent conductor layers are laminated onto a transparent substrate.

A film having high transparency and high electrical conductivity, formed by vacuum deposition or sputtering of tin oxide ($SnO_2$) or indium tin oxide (ITO), has been known as a conventional transparent conductor layer. However, this method requires a film formation time of as long as some dozens of minutes to one hour to form a film having a thickness of 100Å on the substrate. Furthermore, excessive time and complicated production steps are necessary because the substrate must be put into and pulled out from a vacuum system. For these reasons, this method is not suitable for mass-production.

SUMMARY OF THE INVENTION

It is therefore an object of the present invention to provide a photosensitive member for back exposure which eliminates the problems with the prior art and which can be produced easily, and an electrophotographic recording apparatus equipped with such a photosensitive member.

To accomplish the object described above, the present invention provides a photosensitive member comprising a conductor layer, formed by the use of a liquid, and a photosensitive layer formed on the conductor layer.

The present invention also provides an electrophotographic recording apparatus including a photosensitive member, voltage application means for uniformly electrically charging a surface of the photosensitive member, exposure means for effecting exposure from the back of the photosensitive member and forming an electrostatic latent image on the photosensitive member, development means for developing the electrostatic latent image to a toner image, and transfer means for transferring the toner image to recording paper, wherein the photosensitive member comprises a transparent substrate, a transparent conductor layer consisting of a conductive polymer film formed on the transparent substrate by the use of a soluble conductive polymer, and a photosensitive layer formed on the transparent conductor layer.

The conductive polymer described above preferably comprises polyaniline or a derivative, a polypyrrole derivative or a polythiophene derivative.

Furthermore, the present invention provides an electrophotographic recording apparatus, including a photosensitive member, voltage application means for uniformly electrically charging a surface of the photosensitive member, exposure means for effecting exposure from the back of the photosensitive member and forming an electrostatic latent image on the photosensitive member, development means for developing the electrostatic latent image to a toner image, and transfer means for transferring the toner image to recording paper, wherein the photosensitive member comprises a transparent substrate, a transparent conductor layer consisting of a $SnO_2$ film formed by coating a solution of an organotin compound on the transparent substrate, drying and then sintering the solution, and a photosensitive layer formed on the transparent conductor layer.

In this case, the film thickness of the conductor layer consisting of the $SnP_2$ film is preferably from 0.05 to 1.5 μm.

Furthermore, the present invention provides an electrophotographic recording apparatus including a photosensitive member, voltage application means for uniformly charging electrically a surface of the photosensitive member, exposure means for effecting exposure from the back of the photosensitive member and forming an electrostatic latent image on the photosensitive member, development means for developing the electrostatic latent image to a toner image, and transfer means for transferring the toner image to recording paper, wherein the photosensitive member comprises a transparent substrate, a transparent conductor layer consisting of an indium tin oxide (ITO) dispersion resin film formed on the transparent substrate, and a photosensitive layer formed on the transparent conductor layer.

In this case, the film thickness of the conductor layer consisting of the ITO resin dispersion film is preferably from 1 to 20 μm.

BRIEF DESCRIPTION OF THE DRAWINGS

FIGS. 4A and 4B are explanatory views of exposure and development steps in the image formation process by the apparatus shown in FIG. 3A, wherein FIG. 4A is an explanatory view of a first development step and FIG. 4B is an explanatory view of a second development step;

DESCRIPTION OF THE PREFERRED EMBODIMENTS

The photosensitive member according to the present invention can be prepared, for example, by using, as a soluble conductor polymer, a polyaniline or a derivative thereof having a repeating unit expressed by the following general formula 1 and/or 2, and preferably having an average molecular weight of 30,000 to 700,000:

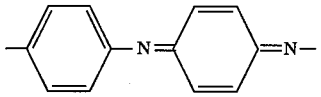

1

-continued

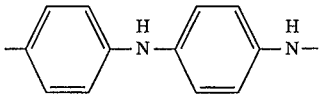

2 or a polypyrrole derivative having a repeating unit expressed by the following formula 3, and preferably having an average molecular weight of some thousands to tens of thousands:

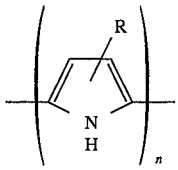

3 or a polythiophene derivative having a repeating unit expressed by the following repeating unit 4, and preferably having an average molecular weight of some thousands to tens of thousands:

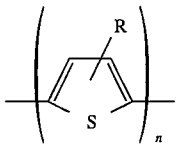

4 diluting the compound with a solvent, coating the resulting solution onto the surface of a transparent substrate, drying the substrate and subjecting it to a doping treatment, or by diluting such a conductive polymer and a dopant by a solvent, coating the resulting solution onto the substrate, drying the substrate to form a transparent conductor layer comprising the conductive polymer film and, further, forming a photosensitive layer on this conductor layer.

Figures 7A, 7B, 7C, 7D, 7E:
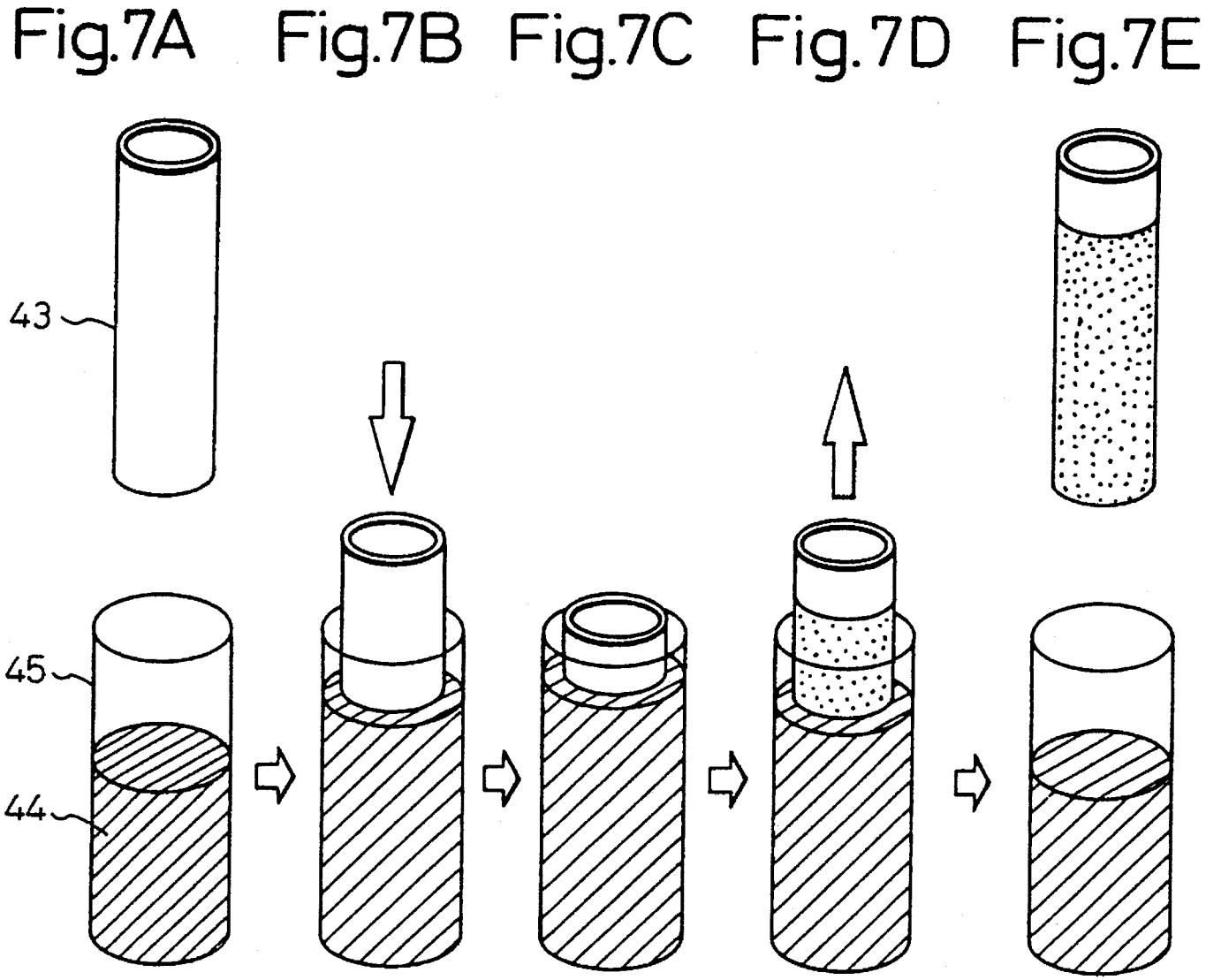
FIGS. 7A, 7B, 7C, 7D and 7E are explanatory views, each showing an example of a method immersion coating of a soluble conductive polymer solution onto a transparent substrate.

Immersion/coating of the solution of the soluble conductor polymer, or the solution of the soluble conductive polymer and the dopant, onto the transparent substrate can be carried out, for example, as shown in FIGS. 7A to 7E. Namely, a glass cylinder 43 is used as the transparent substrate and the solution of the conductive polymer, or the solution 44 of the soluble conductive polymer and the dopant, is poured into a cylindrical container 45 (FIG. 7A). The glass cylinder is gently immersed into this solution up to its upper end (FIG. 7B) and is left for a predetermined time (FIG. 7C). Then, the glass cylinder is gently pulled up (FIG. 7D). In this way, the conductive polymer solution can be coated onto the surface of the glass cylinder (FIG. 7E). In this case, the bottom of the glass cylinder 43 is closed lest the solution 44 enters the glass cylinder 43. After coating is completed throughout the entire surface, the glass cylinder is set into a dryer, and the solvent is dried.

When the solution of only the soluble conductive polymer is immersion-coated, the doping treatment is then carried out. The doping treatment is carried out by treating the glass cylinder, having the conductive polymer film formed thereon, inside a container storing therein the gas of the dopant.

Figures 8A, 8B, 8C, 8D, 8E:
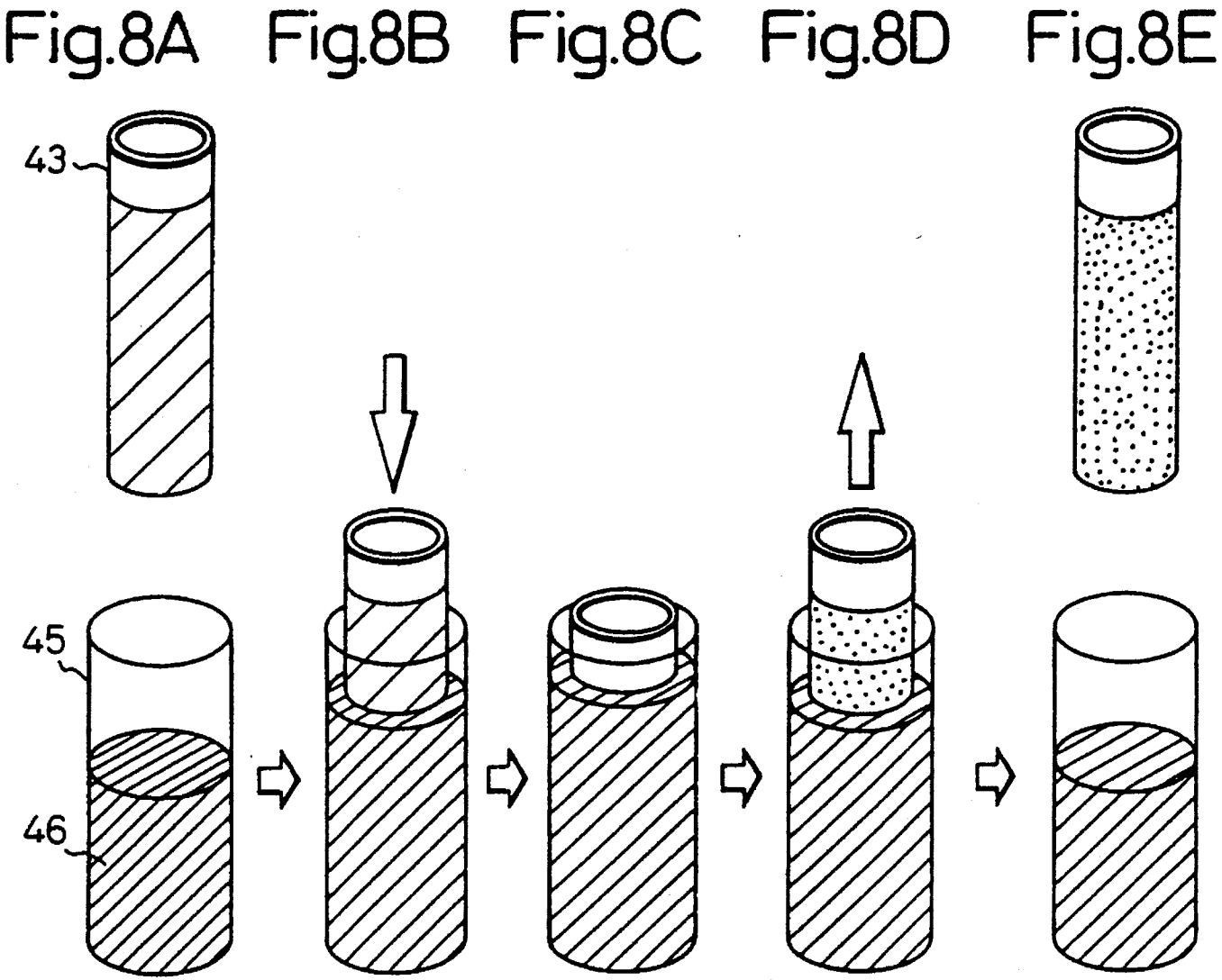
FIGS. 8A, 8B, 8C, 8D and 8E are explanatory views each showing an example of the doping treatment method.

Alternatively, as shown in FIGS. 8A to 8E, a solution 46 containing the dopant may be used (FIG. 8A), and the glass cylinder, having the conductive polymer film formed thereon, is gently immersed into this solution up to its upper portion (FIG. 8B) and is left for a predetermined time (FIG. 8C). Thereafter, the glass cylinder is gently pulled up (FIG. 8D). In this way, the doping treatment is applied to the conductive polymer film (FIG. 8E). After coating is completed over the entire surface thereof, the glass cylinder 43 is set into a dryer and the solvent is dried.

Still alternatively, a solution prepared by diluting an organotin compound with a solvent is coated on the transparent substrate and is dried to form a film of the organotin compound. Next, the film is sintered and thermally decomposed, thereby forming a $SnO_2$ film as a transparent conductor layer on the photosensitive member. Coating of this organotin compound solution onto the transparent substrate can be carried out in exactly the same way as immersion/coating of the conductive polymer solution explained with reference to FIGS. 8A to 8E.

Still alternatively, ITO is dispersed in a solution prepared in advance by diluting a binder resin with a solvent, and the resulting dispersion is coated to the transparent substrate and is then dried, thereby forming an ITO dispersion resin film as the transparent conductor layer. Next, a photosensitive layer is further laminated onto the resulting conductor layer and the photosensitive member is thus produced.

In this case, the smaller the thickness of the conductor layer, the easier it is for the rays of light to pass therethrough. Accordingly, it is possible to obtain a photosensitive member, capable of being exposed from the back, as an electrophotographic photosensitive member for use in an image exposure process, by keeping the film thickness of the conductor layer within a certain range.

In the method of forming the conductor layer described above, the conductor layer can be formed by the steps of coating the solution, drying, and effecting the doping treatment or sintering, whenever necessary. Therefore, the production steps can be much simpler than a vacuum deposition method or a sputtering method, and mass production becomes feasible. Since such a coating method can form a uniform film even on a substrate having a large area which is used for the photosensitive member, the method is more suitable for the formation of the conductor layer of the photosensitive member than the vacuum deposition method and the sputtering method.

To produce the photosensitive member, a solution prepared by diluting the-soluble conductive polymer, which is prepared under a specific polymerization condition, with a general-purpose solvent, is coated on the transparent substrate, is dried thereon and is then subjected to the doping treatment. Alternatively, a solution prepared by diluting the soluble conductive polymer and the dopant with a general-purpose solvent is coated onto the transparent substrate and is dried. Examples of the general-purpose solvents are N-methyl-pyrrolidone, dimethylformamide, pyridine, concentrated sulfuric acid, cyclohexane, etc., for polyaniline and its derivative, and ethanol, benzene, tetrahydrofuran, trichloroethylene, butylcarbitol, etc., for the polypyrrole derivative or the polythiophene derivative. These general-purpose organic solvents can be used either individually or in mixture. The transparent substrate is made of a material having transparency, such as glass, plastics, and so forth. The method of coating onto to the transparent substrate include immersion coating, spray coating, wire bar coating, doctor blade coating, and so forth. An additive, etc., may also be added in consideration of wettability with the transparent substrate. The useful dopants are halogens, aromatic sulfonic acids, aliphatic sulfonic acids, polymer acids having a sulfonic acid group on the side chains, or volatile protonic acids. These acids can be used either individually or in mixture. Preferred halogens are chlorine and bromine, and preferred aromatic sulfonic acids are benzenesulfonic acid, p-toluenesulfonic acid, naphthalenesulfonic acid, alkylnaphthalenesulfonic acid, styrenesulfonic acid, and n-alkylbenzenesulfonic acid. Examples of the aliphatic sulfonic acids are vinylsulfonic acid, methacrylsulfonic acid, dodecylsulfonic acid, trifluorosulfonic acid, etc., and examples of the polymer acids are polyvinylsulfonic acid, polystyrenesulfonic acid and polyphosphoric acid. Examples of the protonic acids are hydrochloric acid and nitric acid. When the doping treatment is carried out, it is possible to employ a method or means which immerses the substrate into the solution containing the dopant and utilizes diffusion from the liquid phase to the film, and a method or means which exposes the layer of the soluble conductive polymer to the gaseous phase containing the dopant and utilizes diffusion from the gaseous phase to the film.

Alternatively, the photosensitive member can be produced by mixing the organotin compound with the general-purpose solvent such as ethanol, buthanol, acetylacetone, butyl carbitol, etc., either individually or in mixture, and coating the solution diluted by the solvent on the transparent substrate. To improve conductivity, a Sb compound, or the like, can be used as the dopant, and an additive may also be added in consideration of wettability with the substrate. Here, if the metal oxide is directly formed on the substrate, alkali ions, etc., mix from the substrate into the film and sometimes lower the conductivity of the film.

In view of the properties of the transparent substrate, a transparent film consisting of a single layer or a plurality of layers of a $SiO_2$ film, etc., may be laminated as an alkali ion preventive film between the transparent substrate and the conductor layer. After coating, the solution is dried, and the film of the organotin compound is formed. When this film is sintered, the organotin compound is thermally decomposed to $SnO_2$, and the conductor layer consisting of the $SnO_2$ film is formed.

Alternatively, ITO is dispersed in the solution prepared by diluting the binder resin by the solvent, and the solution is coated to the transparent substrate. In this case, too, the additive or the like may be added in consideration of wettability. After coating, the solution is dried, and the conductor layer can thus be formed.

Known resins such as polyester, epoxy, silicone, polyvinyl acetal, polycarbonate, acryl, urethane, etc., can be used either individually or in mixture as the binder resin. Various organic solvents such as ethanol, tetrahydrofuran, chloroform, methyl cellosolve, toluene, dichloromethane, etc., can be used as the solvent, either individually or in mixture.

Next, the photosensitive layer is formed on the conductor layer obtained in this foregoing manner. Known inorganic photosensitive layers such as so-called "a-Se photosensitive layer", "a-Si photosensitive layer" and ordinary organic photosensitive layers can be used as such a photosensitive layer. Hereinafter, the present invention will be described using an organic photosensitive layer by way of example, but the present invention is not particularly limited thereto.

The organic photosensitive layer may be either of a single-layer type or a laminated type organic photosensitive layer formed by laminating a charge generation layer—a charge transfer layer, or a charge transfer layer—charge generation layer in the order named, but as the structure of the photosensitive member used for the apparatus of the present invention, the organic photosensitive layer obtained by sequentially laminating the charge generation layer and the charge transfer layer, in the order named, is preferred. Each of these layers can generally be obtained by binding a charge generation substance or a charge transfer substance by a binder resin, and is coated by known means such as immersion coating, spray coating, doctor blade coating, and so forth. When a substance having sublimability such as a phthalocyanine pigment is used, the charge generation layer may be formed by the vacuum deposition method. The charge generation layer (preferably) has a thickness of about 0.1 to about 5 μm, particularly a thickness of up to 1 μm, and the charge transfer layer preferably has a film thickness of about 5 to about 30 μm.

Known dyes or pigments such as a phthalocyanine type, a sucarylium type, a perrillene type, etc., can be used either individually or in mixture as the charge generation substance, and they are selected in consideration of spectral sensitivity characteristics. Those compounds, which can transfer either the positive holes or electrons of the photocarriers generated by the charge generation layer, are used either individually or in mixture as the charge transfer substance. Hydrazone, triarylamine, trinitrofluorenone, etc., for example, are known as positive hole transferrable charge transfer substances. Further, it is possible to use those photoconductive polymers which by themselves have the charge transfer property, such as polyvinylcarbazole and polysilane. In this case, the binder resin need not be used.

Known resins such as polyester, epoxy, silicone, polyvinyl acetal, polycarbonate, acryl, urethane, etc., can be used either individually or in mixture, as the binder resin. Various organic solvents such as alcohol, tetrahydrofuran, chloroform, methyl cellosolve, toluene, dichloromethane, etc., can be used either individually or in mixture as the solvent for coating and forming each of the layers by the means described above.

An intermediate layer consisting of a resin such as cellulose, pullulan, casein, PVA, etc., may be disposed between the conductor layer and the photosensitive layer. A preferred film thickness of this intermediate layer is from 0.1 to 5 μm, and more preferably, it is from 1 to 2 μm. The intermediate layer can be coated and formed by known means in the same way as the photosensitive layer.

When the transparent substrate is cylindrical and the transparent conductor layer is formed on the transparent substrate during the production of the photosensitive layer described above, it is preferred to rotate the solution coated on the transparent substrate round the axis of the cylinder and to dry it by drying means disposed outside the peripheral surface of the substrate. Alternatively, the solution coated on the transparent substrate is dried by drying means so disposed as to cover the outside of the peripheral surface of the substrate as a whole. When a homogeneous film is formed using polyaniline prepared by the oxidation polymerization of aniline or its derivative as the conductor polymer, such a drying means is particularly useful. Now, this will be explained in further detail.

Figure 1:
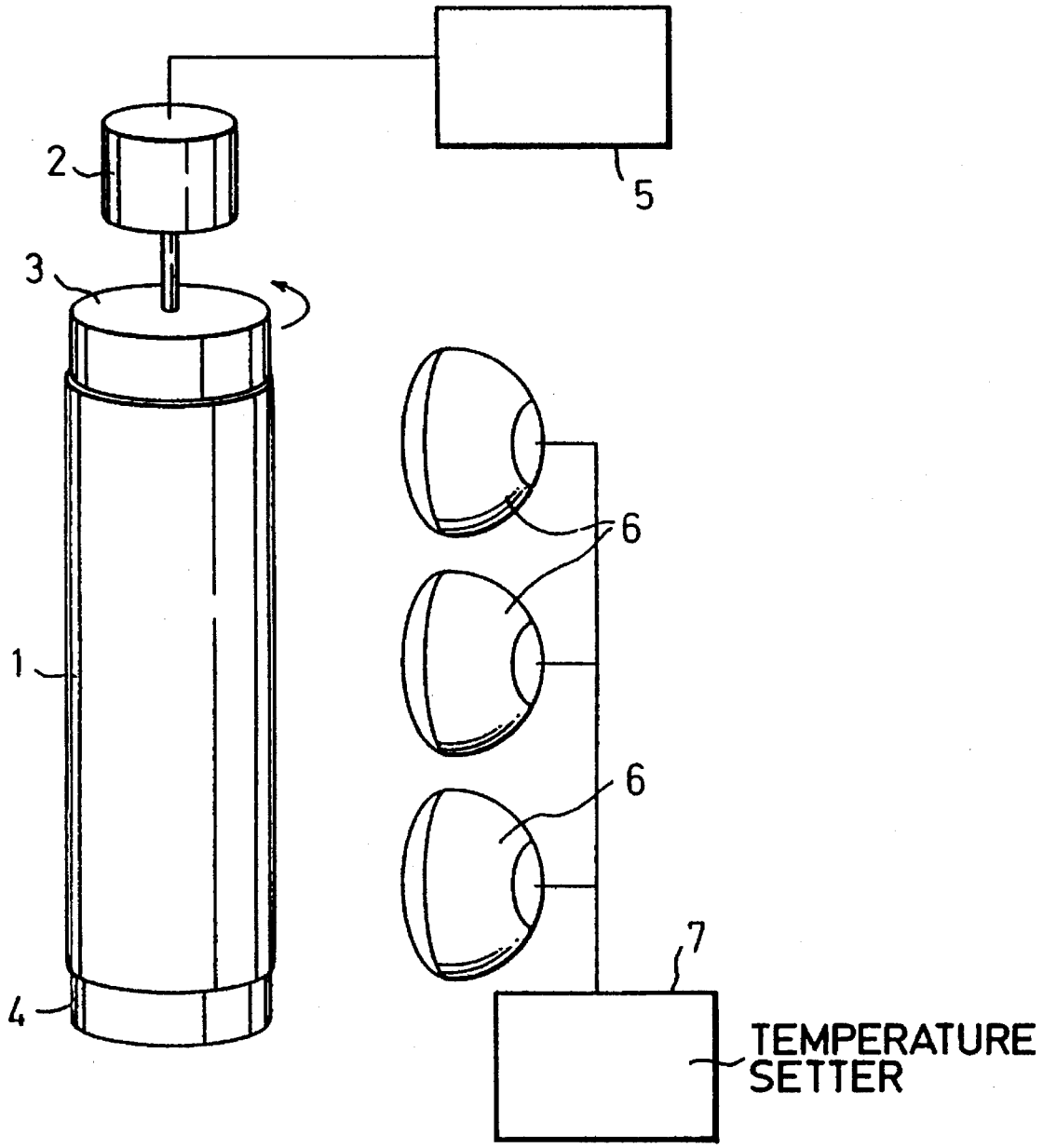
FIG. 1 is a schematic view showing an example of a dryer used for producing a photosensitive member.

In FIG. 1, reference numeral 1 denotes the transparent substrate, 2 is a rotation driving device, 3 is an upper holder, 4 is a lower holder, 5 is a rotation controller, 6 is a radiation type heater, and 7 is a temperature setter. An inorganic glass material or an organic polymer material is used for the transparent substrate 1. It is possible to use, for example, inorganic glass such as Pyrex glass, or a transparent resin such as methyl polymethacrylate or a polycarbonate. A general-purpose controllable rotary device such as a servo motor, a stepping motor, an induction motor, etc., can be used as the rotation driving device 2. The rotation driving device 2 can be set to an arbitrary rotating speed by the rotation controller 5. The transparent substrate 1 can revolve around the axis of the transparent substrate 1 by the upper holder 3 and the lower holder 4. The radiation type heater 6 is a heating source such as a visible-light lamp or an infrared-ray lamp, heats the substrate 1 and can be set to produce an arbitrary temperature by the temperature setter 7.

To operate this apparatus, a solution of the conductive polymer such as polyaniline is first coated onto the transparent substrate 1 by immersion-coating. The upper holder 3 and the lower holder 4 are fitted to the transparent substrate 1, and then the rotation driving device 2 is connected. The rotation driving device is rotated at a rotating speed of 500 to 1,000 rpm by the rotation controller 5. While the rotation driving device is being rotated, the temperature of the transparent substrate 1 is gradually raised by the radiation type heater so as to evaporate and remove the solvent from the solution and to form the thin film of the conductive polymer. The dried surface temperature at this time is preferably from 30° to 200° C.

Figure 2:
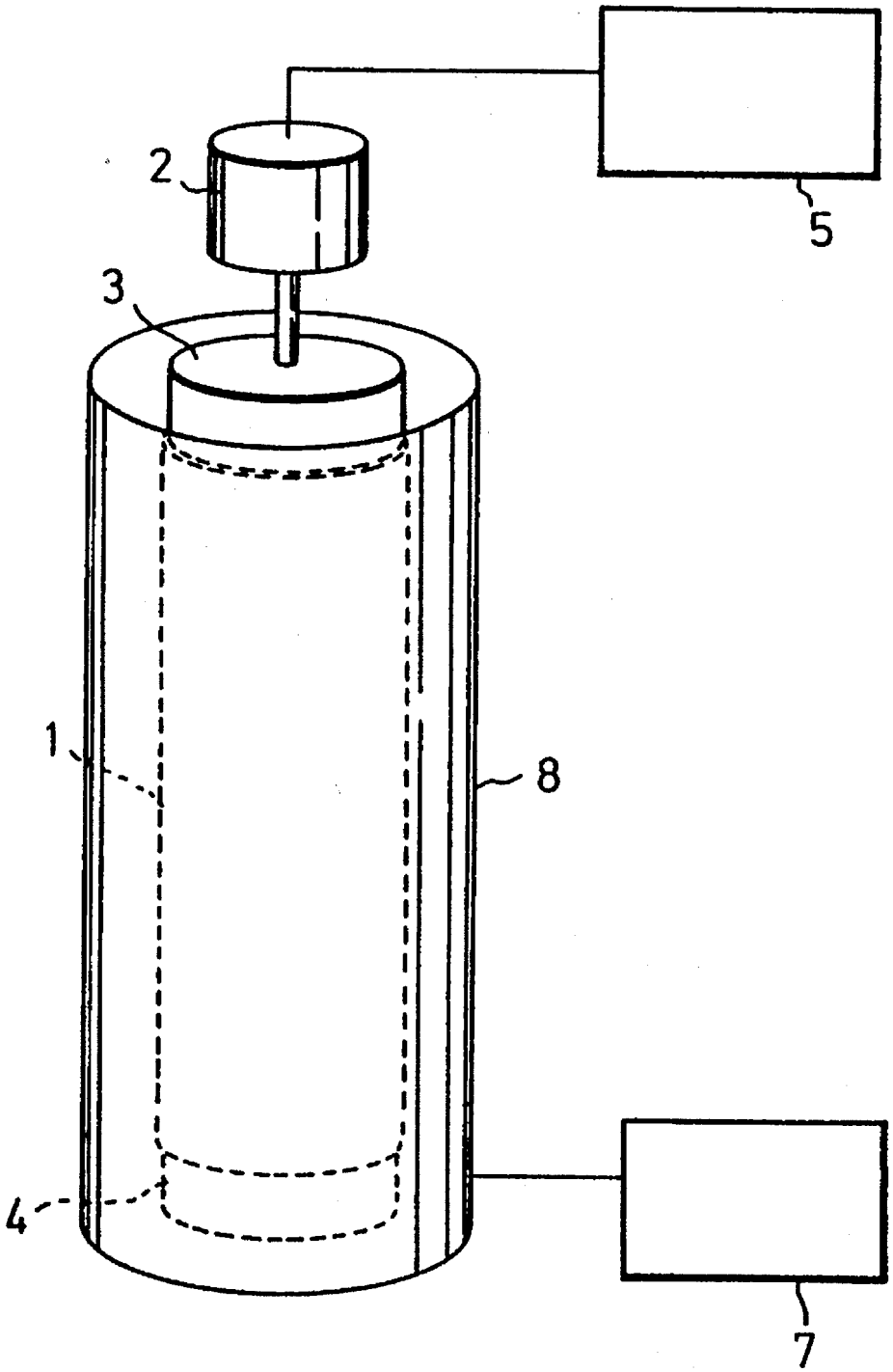
FIG. 2 is a schematic view showing another example of a dryer used for producing a photosensitive member.

Other means can be used as the heating means. FIG. 2 shows an example where a natural convection type heater 8 is used as the heating means. The other constituent portions are the same as those in FIG. 1. In this case, the heater 8 so disposed as to cover the transparent substrate 1 as a whole uniformly heats the solution of the conductive polymer coated on the surface of the transparent substrate. Since the solution is uniformly dried, the substrate need not be rotated by the rotation driving device 2.

Further, it is possible to use a known means (Japanese Unexamined Patent Publication (Kokai) No. 58-179841) for heating the cylindrical substrate from its inside, as the heating means, and to conduct heating and drying at a predetermined temperature by adding a temperature controller for controlling the heating temperature. In this case, too, similar effects can be obtained.

Figures 3A, 3B:
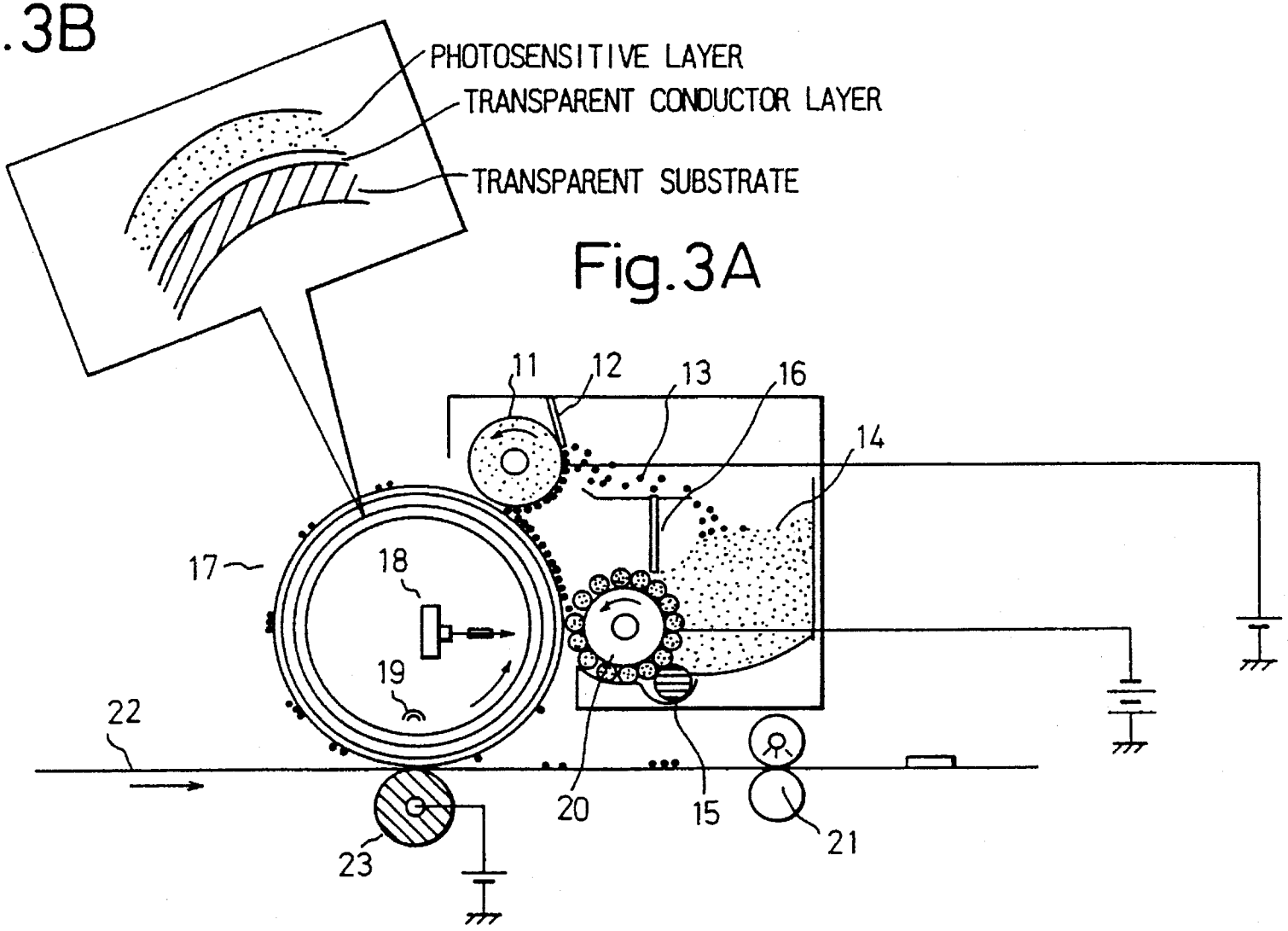
FIG. 3A is a schematic, sectional view of a printer for back exposure.
FIG. 3B is a partial enlarged view of a photosensitive drum.

An example of the construction of the electrophotographic recording apparatus according to the present invention equipped with the photosensitive member obtained in this manner is shown in FIGS. 3A and 3B. FIG. 3A is a sectional view of a printer for back exposure, and FIG. 3B is a partial enlarged view of its photosensitive drum portion. An image formation process for back exposure is carried out in the following way using such an apparatus.

A developer 14 comprises a conductive magnetic carrier and a toner 13, which have mutually opposite polarities. The toner adheres to the carrier surface. A developing roller 20, equipped therein with a magnetic roller having magnetism, attracts the carrier and rotates. A voltage is applied between the developing roller surface and a transparent conductor layer of the photosensitive drum 17. After the voltage is applied, the toner falls off from the carrier due to the force of electricity, uniformly covers the surface of the photosensitive member and electrically charges the photosensitive member (charging step).

Figure 4A:
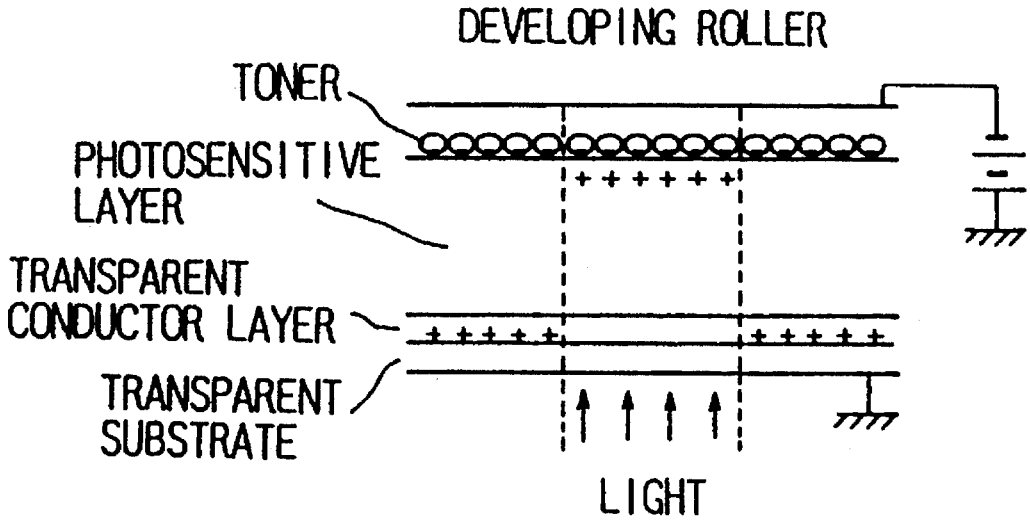
Figure 4B:
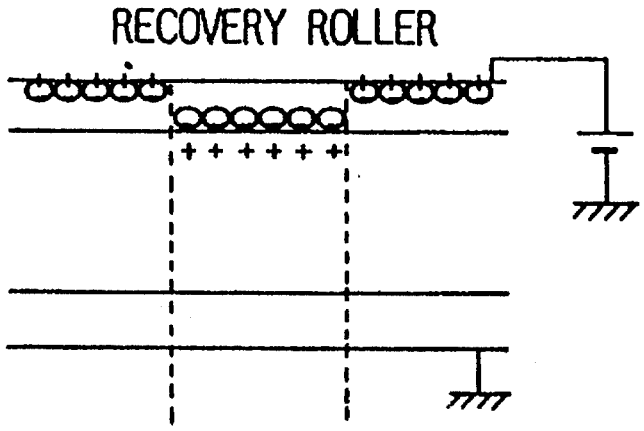

As shown in further detail in FIGS. 4A and 4B, the development process includes a first development step (FIG. 4A) for covering the photosensitive member with the toner and a second development step (FIG. 4B) for recovering the toner at portions other than the image portion. Accordingly, the charge of the transparent conductor layer migrates inside the photosensitive member due to the force of electricity, and attracts the toner towards the photosensitive member. After exposure, the toner at portions other than the exposure portion is scraped off by the force of the electric charge on the recovery roller 11, and a toner image is formed only at the exposed portion (exposure and development steps).

The toner image thus formed on the photosensitive member is transferred by the force of the electric charge, and the pressure of a transfer machine 23, onto a recording paper 22 (transfer step).

The toner transferred to the recording paper is heated by a fixing machine 21, and is fixed to the recording paper. In this way, printing is completed.

Hereinafter, the present invention will be explained in further detail with reference to Examples thereof, in which the term "part(s)" means "part(s) by weight".

EXAMPLE 1

A glass cylinder having a diameter of 30 mm and a length of 260 mm was used as the transparent substrate of the photosensitive member. A solution prepared by dissolving one part of polyaniline (weight average molecular weight of about 40,000) in 95 parts of N-methyl-pyrrolidone was poured into a cylindrical container, and the glass cylinder was gently immersed into this solution to its upper portion. After being left for one minute, the glass cylinder was gently pulled up at a rate of 1 mm/sec, and the polyaniline solution coated the surface of the glass cylinder (hereinafter, this operation will be referred to as "immersion-coating"). After coating was completed to the entire surface, the glass cylinder was set into a dryer. While rotation was being applied to the glass cylinder at a rotating speed of 10 rpm, the surface was heated to 100° C. and the solvent was removed.

Thereafter, the polyaniline film formed on the transparent substrate was put into a container filled with the vapor of hydrochloric acid for 10 minutes so as to conduct doping treatment from the gaseous phase of hydrochloric acid. In this way, a 0.5 μm-thick conductor layer was formed.

Next, one part of cyanoethylated pullulan was dissolved in 10 parts of acetone, and the resulting solution was immersion-coated on the conductor layer and was dried at 100° C. for one hour to form an intermediate layer having a film thickness of 1 μm. Next, one part of alpha-titanium oxide-phthalocyanine, one part of polyester and 20 parts of 1,1,2-trichloroethane were dispersed and mixed for 24 hours using hard glass balls and a hard glass pot, and the dispersion was coated to the intermediate layer described above and was dried at 100° C. for one hour to form a charge generation layer having a film thickness of about 0.3 μm. One part of butadiene and one part of polycarbonate were dissolved in 17 parts of dichloromethane so as to prepare a coating solution. The resulting coating solution was immersion-coated on the charge generation layer, and was dried at 90° C. for one hour to form a charge transfer layer having a film thickness of about 15 μm. In this way, a photosensitive layer was formed, and the photosensitive member of Example 1 was thus obtained.

EXAMPLE 2

A photosensitive member of Example 2 was obtained in exactly the same way as in Example 1 except that the film thickness of the conductor layer was changed to 0.1 μm.

EXAMPLE 3

A glass cylinder having a diameter of 30 mm and a length of 260 mm was used as the transparent substrate of the photosensitive member. A solution prepared by dissolving one part of polyaniline and one part of polystyrenesulfonic acid as a dopant in 95 parts of N-methyl-2-phyrrolidone was poured into a cylindrical container, and the glass cylinder was gently immersed into this solution to its upper portion. One minute later, the glass cylinder was gently pulled up at a rate of 1 mm/sec and the solution coated the surface of the glass cylinder. After coating was completed the glass cylinder was set into a dryer, and while the glass cylinder was rotated at a rotating speed of 10 rpm, the surface was heated to 100° C. and the solvent was removed. The film thickness of the conductor layer was 0.1 μm. The photosensitive layer was formed on this conductor layer in the same way as in Example 1, and the photosensitive member of Example 3 was obtained.

EXAMPLE 4

The photosensitive member of Example 4 was obtained in exactly the same way as in Example 1 except that the film thickness of the conductor layer was changed to 0.05 μm.

EXAMPLE 5

The photosensitive member of Example 5 was obtained in exactly the same way as in Example 1 except that the film thickness of the conductor layer was changed to 1.5 μm.

COMPARATIVE EXAMPLE 1

The photosensitive member of Comparative Example 1 was obtained in exactly the same way as in Example 1 except that the film thickness of the conductor layer was changed to 0.01 μm.

COMPARATIVE EXAMPLE 2

The photosensitive member of Comparative Example 2 was obtained in exactly the same way as in Example 1 except that the film thickness of the conductor layer was changed to 3.0 μm.

Figure 5:
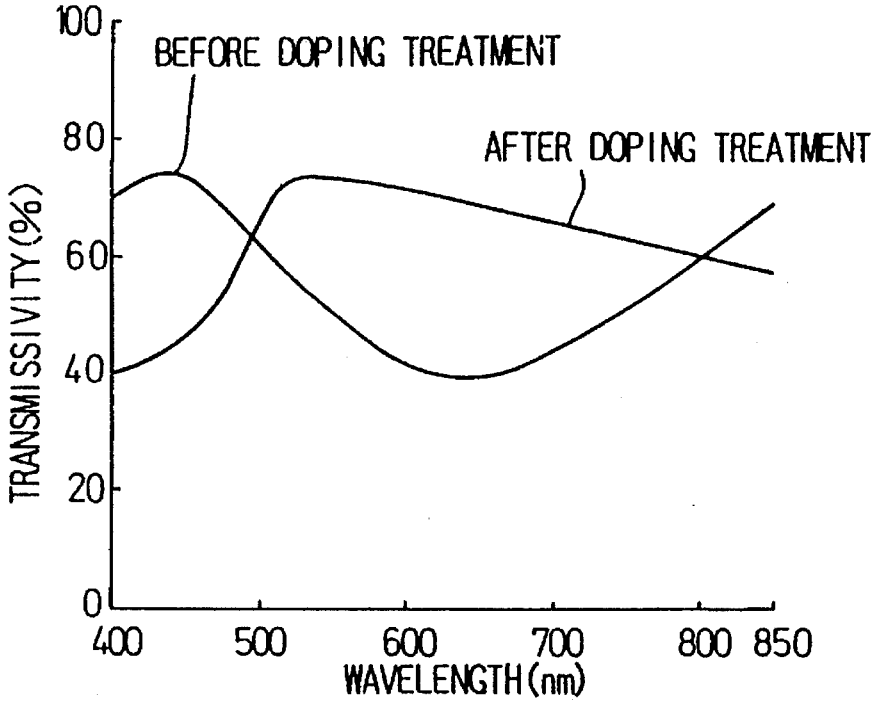
FIG. 5 is a diagram showing the relationship between wavelengths of transmitted light of a polyaniline film, before and after doping treatment and its corresponding transmissivity.

FIG. 5 shows the relationship between the wavelength of transmitted light and transmissivity of the polyaniline film (film thickness: 0.8 μm) before and after the doping treatment. The polyaniline film was prepared by coating a solution, which was prepared by diluting one part of soluble polyaniline with 95 parts of N-methyl-2-pyrrolidone, onto the glass substrate and drying the resulting film at 80° C. for 30 minutes under a reduced pressure. The doping treatment was carried out by exposing this film to a hydrochloric acid vapor for about 10 minutes. The relationship between the wavelength and transmissivity of the polyaniline film, after the doping treatment, shifted to a higher wavelength side in comparison with the relationship before the doping treatment, and transmissivity rose for wavelengths within the range of 500 to 800 nm. The wavelengths of optical systems, e.g. LED arrays, of image exposure means used for the electrophotographic recording system are mostly from 500 to 800 nm. From this fact, the polyaniline film after the doping treatment is believed suitable for the process which effects exposure from the back of the photosensitive member.

Figure 6:
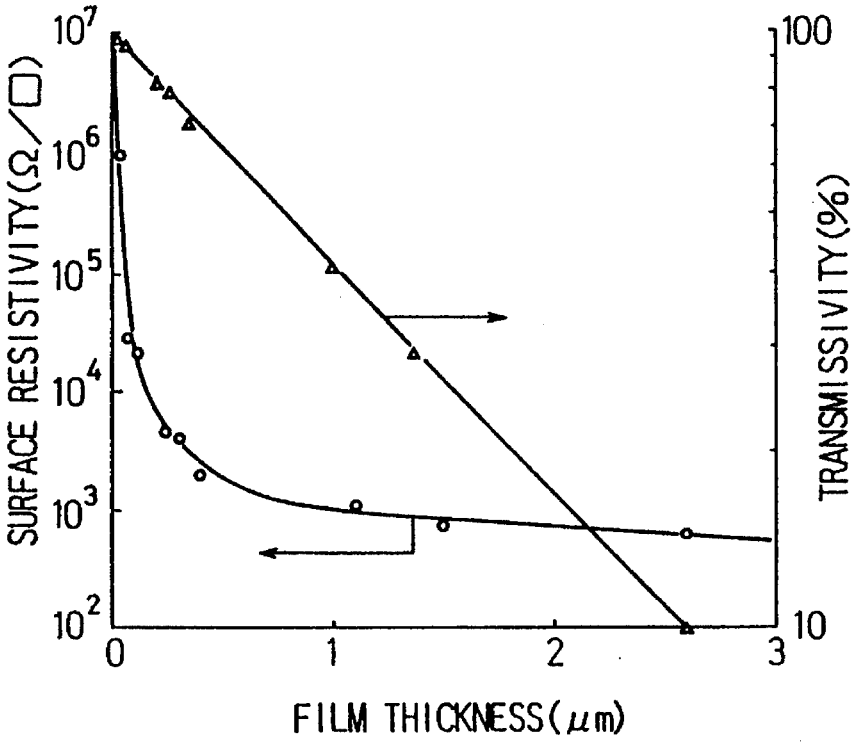
FIG. 6 is a diagram showing the relationship between the film thickness of the polyaniline film after the doping treatment, its surface resistivity and the transmissivity of light having a wavelength of 660 nm.

FIG. 6 shows the relationship between the film thickness of the polyaniline film after the doping treatment, its surface resistivity and the transmissivity thereof of light having a wavelength of 660 nm. By the way, this wavelength of 660 nm is the wavelength of light of an LED array. The transmissivity of the conductor layer prepared in the Examples and the surface resistivity plotted from FIG. 6 are tabulated in Table 1. The transmissivity of the conductor layer and surface resistivity of Example 4 were measured at the time of formation of the conductor layer.

Characteristics of the photosensitive members were evaluated using the photosensitive members obtained in the Examples and Comparative Examples, and printing tests were carried out. The sensitivity characteristics were measured by negatively charging the surface of each photosensitive member, irradiating light from the side of the photosensitive layer, and measuring a half-life exposure quantity and a residual potential from the attenuation of the potential on the surface of the photosensitive member. The printing test was carried out by fitting each photosensitive member of an Example to a prototype printer for back exposure which effected exposure from the back of the photosensitive member as shown in FIGS. 3A and 3B. An LED array was used for exposure, and a two-component developer consisting of an insulating toner and a magnetic carrier was used for development. The characteristics of the photosensitive members and the results of the printing test are tabulated in Table 1. The photosensitive members of Examples 1 to 3 did not generate any problem, such as in a relation to a density of the image, and printing could be made. Though the photosensitive member of Example 4 could obtain a printed matter, the image density was somewhat low at the portion having the greatest distance from the portion at which the conductor layer was connected to the ground side of the apparatus. The photosensitive member of Example 5 provided a printed matter having a low image density as a whole. This was presumably because image exposure was not sufficiently effected because the transmissivity was low. In the case of the photosensitive member of Comparative Example 1, the potential hardly fell even when the light was irradiated, and the characteristics of this photosensitive member could not be examined. Further, the printed matter could not be obtained in the printing test. In the photosensitive member of Comparative Example 2, the light for image exposure hardly passed through the conductor layer. Accordingly, printed matter could not be obtained. It can be seen from the results described above that the photosensitive member could be applied to the process which effected exposure from the back of the photosensitive member when the range of the film thickness of the conductor layer was 0.05 to 1.5 μm, particularly was 0.1 to 0.6 μm.

TABLE 1

| | film thickness (μm) | transmissivity (%) | surface resistivity (Ω/□) | half-life exposure (μJ/cm²) | residual potential (−V) | evaluation of printing characteristics |
|---|---|---|---|---|---|---|
| Example 1 | 0.5 | 70 | $2 \times 10^3$ | 0.4 | 45 | ○ |
| Example 2 | 0.1 | 70 | $10^4$ | 0.5 | 50 | ○ |
| Example 3 | 0.1 | 70 | $10^4$ | 0.5 | 50 | ○ |
| Example 4 | 0.05 | 96 | $3 \times 10^4$ | 0.6 | 60 | Δ |
| Example 5 | 1.5 | 30 | $8 \times 10^2$ | 0.3 | 40 | Δ |
| Comp. Example 1 | 0.01 | 98 | $3 \times 10^6$ | 0.8 | 80 | × |
| Comp. Example 2 | 2.5 | 10 | $4 \times 10^2$ | 0.3 | 40 | × |

Note: Characteristics of the photosensitive member were measured by effecting exposure from outside the photosensitive member.

EXAMPLE 6

A glass cylinder was used as the transparent substrate of the photosensitive member. A solution prepared by diluting one part of a polypyrrole derivative, having the following structural formula 5, with 50 parts of tetrahydrofuran was immersion-coated to the substrate in the same way as in Example 1. After coating, the substrate was dried at 100° C. for 10 minutes, and a film having a film thickness of 0.2 μm was formed. Thereafter, the polypyrrole film formed on the transparent substrate was placed into a container filled with a bromine vapor for 10 minutes, and the doping treatment was carried out from the gaseous phase of bromine, thereby forming the conductor layer. Next, one part of cyanoethylated pullulan was dissolved in 10 parts of acetone, and the resulting solution was immersion-coated to the conductor layer in the same way as in Example 1 and was dried at 100° C. for one hour to form an intermediate layer having a film thickness of 1 μm. Next, alpha-titanium oxide phthalocyanine, one part of polyester and 20 parts of 1,1,2-trichloroethane were dispersed and mixed using hard glass balls and a hard glass pot for 24 hours, and the resulting dispersion was coated onto the intermediate layer and was dried at 100° C. for one hour to form a charge generation layer having a film thickness of about 0.3 μm. A coating solution was then prepared by dissolving one part of a butadiene derivative and one part of polycarbonate in 17 parts of dichloromethane, was immersion-coated onto the charge generation layer described above and was dried at 90° C. for one hour to form a charge transfer layer having a film thickness of about 15 μm. In this way, the photosensitive member of Example 6 was obtained.

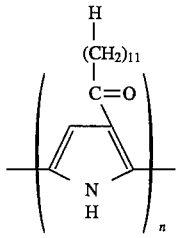

EXAMPLE 7

The photosensitive member of Example 7 was obtained in exactly the same way as in Example 6 except that the film thickness of the conductor layer was changed to 0.05 μm.

EXAMPLE 8

The photosensitive member of Example 8 was obtained in exactly the same way as in Example 6 except that the film thickness was changed to 0.5 μm.

COMPARATIVE EXAMPLE 3

The photosensitive member of Comparative Example 3 was obtained in exactly the same way as in Example 6 except that the film thickness of the conductor layer was changed to 0.01 μm.

COMPARATIVE EXAMPLE 4

The photosensitive member of Comparative Example 4 was obtained in exactly the same way as in Example 6 except that the film thickness of the conductor layer was changed to 1.0 μm.

EXAMPLE 9

A glass cylinder was used as the transparent substrate of the photosensitive member. A solution prepared by diluting one part of a polythiophene derivative, having the following structural formula 6, with 50 parts of tetrahydrofuran was immersion-coated onto the substrate in the same way as in Example 1. After coating, the substrate was dried at 100° C.

for 10 minutes to form a film having a film thickness of 0.3 μm. Thereafter, the polythiophene derivative film formed on the transparent substrate was placed into a container filled with a bromine vapor, and the doping treatment was carried out from the gaseous phase of bromine to form a conductor layer. Next, one part of cyanoethylated pullulan was dissolved in 10 parts (by weight) of acetone, and the resulting solution was immersion-coated onto the conductor layer in the same way as in Example 1 and was dried at 100° C. for one hour to an intermediate layer having a film thickness of 1 μm. Next, one part of alpha-titanium oxide phthalocyanine, one part of polyester and 20 parts of 1,1,2-trichloroethane were dispersed and mixed using hard glass balls and a hard glass pot for 24 hours, and the resulting dispersion was coated to the intermediate layer and was dried at 100° C. for one hour to form a charge generation layer having a film thickness of about 0.3 μm. A coating solution was prepared by dissolving one part of a butadiene derivative and one part of polycarbonate in 17 parts by dichloromethane, was immersion-coated onto the charge generation layer, and was dried at 90° C. for one hour to form a charge transfer layer having a film thickness of about 15 μm. In this way, the photosensitive layer was formed, and the photosensitive member of Example 9 was obtained.

6

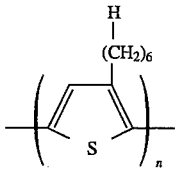

EXAMPLE 10

The photosensitive member of Example 10 was obtained in exactly the same way as in Example 9 except that the film thickness of the conductor layer was changed to 0.05 μm.

EXAMPLE 11

The photosensitive member of Example 11 was obtained in exactly the same way as in Example 9 except that the film thickness was changed to 1.0 μm.

COMPARATIVE EXAMPLE 5

The photosensitive member of Comparative Example 5 was obtained in exactly the same way as in Example 9 except that the film thickness of the conductor layer was changed to 0.01 μm.

COMPARATIVE EXAMPLE 6

The photosensitive member of Comparative Example 6 was obtained in exactly the same way as in Example 9 except that the film thickness of the conductor layer was changed to 1.5 μm.

Characteristics of each of the photosensitive members were evaluated using those obtained in Examples and Comparative Examples, in exactly the same way as in Examples 1 to 5 and in Comparative Examples 1 and 2, and printing tests were also carried out. The characteristics of the photosensitive members and the results of the printing test are tabulated in Table 2. The photosensitive members of Examples 6 and 9 could make printing without causing any problem in the image density, and the like. Though the photosensitive members of Examples 7 and 10 could produce the printed matter, the image density was somewhat low at portions having the greatest distance from the portion at which the conductor layer was connected to the ground of the apparatus. The photosensitive members of Examples 8 and 11 provided the printed matters having the low image density as a whole. This was presumably because the image exposure was not effected sufficiently because the transmissivity was low. In the case of Comparative Examples 3 and 5, the potential hardly fell even when light irradiation was made, and the characteristics of the photosensitive members could not be examined. In the printing test, printed matter could not be obtained. In the case of the photosensitive members of Comparative Examples 4 and 6, since light for image exposure hardly passed through the conductor layer, printed matter could not be obtained.

It can be understood from the results described above that the polypyrrole derivative film and the polythiophene derivative as the conductor layer can be applied to the process for effecting exposure from the back of the photosensitive member when the film thickness is within the range of 0.05 to 0.5 μm, particularly from 0.1 to 0.3 μm for the former, and within the range of 0.05 to 1.0 μm, particularly 0.1 to 0.5 μm, for the latter.

TABLE 2

| | film thickness (μm) | transmissivity (%) | surface resistivity (Ω/□) | half-life exposure (μJ/cm²) | residual potential (−V) | evaluation of printing characteristics |
|---|---|---|---|---|---|---|
| Example 6 | 0.2 | 84 | $3 \times 10^3$ | 0.25 | 40 | ○ |
| Example 7 | 0.05 | 92 | $3 \times 10^6$ | 0.51 | 60 | Δ |
| Example 8 | 0.5 | 48 | $6 \times 10^2$ | 0.23 | 35 | Δ |
| Example 9 | 0.3 | 78 | $4 \times 10^4$ | 0.41 | 50 | ○ |
| Example 10 | 0.05 | 88 | $9 \times 10^5$ | 0.50 | 55 | Δ |
| Example 11 | 1.0 | 40 | $4 \times 10^2$ | 0.23 | 40 | Δ |
| Comp. Example 3 | 0.01 | 98 | $4 \times 10^6$ | 0.81 | 80 | × |
| Comp. Example 4 | 1.0 | 10 | $3 \times 10^2$ | 0.23 | 40 | × |
| Comp. Example 5 | 0.01 | 90 | $5 \times 10^7$ | 0.82 | 80 | × |
| Comp. Example 6 | 1.5 | 10 | $4 \times 10^3$ | 0.26 | 40 | × |

Note: Characteristics of the photosensitive members were measured by effecting exposure from outside the photosensitive member.

EXAMPLE 12

A cylinder of soda lime glass was used as the transparent substrate of the photosensitive member. A solution prepared by diluting one part of monoethylethoxysilane in a mixed solvent of three parts of butyl alcohol and two parts of glacial acetic acid, was immersion-coated onto the substrate in the same way as in Example 1, and was dried at 100° C. for one hour to form a $SiO_2$ film as an alkali ion preventive film. A solution prepared by diluting 19 parts of dibutyltin dichloride, having the following structural formula 7, and one part of $Sb_2O_3$ as a dopant with 80 parts of an ethanol solvent was immersion-coated onto the $SiO_2$ film in the same way as in Example 1. After coating, the substrate was dried at 80° C. for 30 minutes, and a film having a film thickness of 0.5 μm was formed. This film was tentatively sintered at 150° C. for 150 minutes and was then sintered primarily at 500° C. for 40 minutes so as to form a $SnO_2$ film. Next, one part of cyanobutylated pullulan was dissolved in 10 parts of acetone, and the resulting solution was immersion-coated onto the $SnO_2$ conductor layer and was dried at 100° C. for one hour to form an intermediate layer having a film thickness of 1 μm. Next, one part of alpha-titanium oxide phthalocyanine, one part of polyester and 20 parts of 1,1,2-trichloroethan were dispersed and mixed using hard glass balls and a hard glass pot for 24 hours, and the resulting dispersion was coated onto the intermediate layer and was dried at 100° C. for one hour to form a charge generation layer having a film thickness of about 0.3 μm. A coating solution was prepared by dissolving one part of a butadiene derivative and one part of polycarbonate in 17 parts of dichloromethane. The coating solution was then immersion-coated onto the charge generation layer and was dried at 90° C. for one hour to form a charge transfer layer having a film thickness of about 15 μm. In this way, the photosensitive layer was formed, and the photosensitive member of Example 12 was obtained.

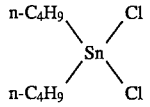

7

EXAMPLE 13

The photosensitive member of Example 13 was prepared in exactly the same way as in Example 12 except that the film thickness of the conductor layer was changed to 0.05 μm.

EXAMPLE 14

The photosensitive member of Example 14 was prepared in exactly the same way as in Example 12 except that the film thickness of the conductor layer was changed to 2.0 μm.

COMPARATIVE EXAMPLE 7

The photosensitive member of Comparative Example 7 was prepared in exactly the same way as in Example 12 except that the film thickness of the conductor layer was changed to 0.01 μm.

COMPARATIVE EXAMPLE 8

The photosensitive member of Comparative Example 8 was obtained in exactly the same way as in Example 12 except that the film thickness of the conductor layer was changed to 3.0 μm.

EXAMPLE 15

A glass cylinder was used as the transparent substrate of the photosensitive member. One part of ITO fine powder (shape: scale-like, up to 10 μm), one part of polycarbonate and 17 parts of dichloromethane were dispersed and mixed using hard glass balls and a hard glass pot for 24 hours, and the resulting dispersion was coated onto the transparent substrate in the same way as in Example 1. After coating, the substrate was dried at 90° for one hour, and a conductor layer consisting of a 5 μm-thick film was formed. Next, one part of cyanoethylated pullulan was dissolved in 10 parts of acetone, and the resulting solution was immersion-coated onto the conductor layer and was dried at 100° C. for one hour so as to form an intermediate layer having a film thickness of 1 μm. Next, one part of alpha-titanium oxide phthalocyanine, one part of polyester and 20 parts of 1,1,2-trichloroethane were dispersed and mixed for 24 hours using hard glass balls and a hard glass pot, and the resulting dispersion was coated onto the intermediate layer and was dried at 100° C. for one hour to form a charge generation layer having a film thickness of about 0.3 μm. A coating solution was then prepared by dissolving one part of a butadiene derivative and one part of polycarbonate in 17 parts of dichloromethane, was then immersion-coated onto the charge generation layer, and was dried at 90° C. for one hour to form a charge transfer layer having a film thickness of about 15 μm. In this way, the photosensitive layer was formed, and the photosensitive member of Example 15 was obtained.

EXAMPLE 16

The photosensitive member of Example 16 was obtained in exactly the same way as in Example 15 except that the film thickness of the conductor layer was changed to 1.0 μm.

EXAMPLE 17

The photosensitive member of Example 17 was obtained in exactly the same way as in Example 15 except that the film thickness of the conductor layer was changed to 20 μm.

COMPARATIVE EXAMPLE 9

The photosensitive member of Comparative Example 9 was obtained in exactly the same way as in Example 15 except that the film thickness of the conductor layer was changed to 0.1 μm.

COMPARATIVE EXAMPLE 10

The photosensitive member of Comparative Example 10 was obtained in exactly the same way as in Example 15 except that the film thickness of the conductor layer was changed to 30 μm.

Characteristics of the photosensitive member were evaluated using the photosensitive members obtained in Examples and Comparative Examples in exactly the same way as in Examples 1 to 5 and Comparative Examples 1 and 2, and printing tests were carried out. The characteristics of the photosensitive members and the results of the printing tests are tabulated in Table 3. According to the photosensitive members of Examples 12 and 15, printing could be made without causing any problem in the image density, and so forth. In the photosensitive members of Examples 13 and 16, printed matter could be obtained, but the image density was somewhat low at the portion at the greatest distance from the portion at which the conductor layer was connected to the ground of the apparatus. According to the photosensitive members of Examples 14 and 17, printed matter having a low image density as a whole could be obtained. This was presumably because the transmissivity was low and the image exposure was not carried out sufficiently. In the photosensitive members of Comparative Examples 7 and 9, the potential hardly fell even when light was irradiated, and the photosensitive characteristics could not be examined. Further, printed matter could not be obtained in the printing test. According to the photosensitive members of Comparative Examples 8 and 10, printed matter could not be obtained because light for the image exposure hardly passed through the conductor layer.

It can be understood from the results described above that the $SnO_2$ film and the ITO dispersion resin film could be applied to the process for effecting exposure from the back of the photosensitive member when the thickness is from 0.05 to 1.5 μm, particularly from 0.1 to 0.6 μm, for the former, and from 1 to 20 μm, particularly from 5 to 10 μm, for the latter, as the conductor layer.

TABLE 3

| | film thickness (μm) | transmissivity (%) | surface resistivity (Ω/□) | half-life exposure (μJ/cm²) | residual potential (−V) | evaluation of printing characteristics |
|---|---|---|---|---|---|---|
| Example 12 | 0.5 | 80 | $2 \times 10^3$ | 0.3 | 40 | ○ |
| Example 13 | 0.1 | 90 | $10^6$ | 0.6 | 60 | Δ |
| Example 14 | 2.0 | 30 | $7 \times 10^2$ | 0.2 | 35 | Δ |
| Example 15 | 5.0 | 75 | $3 \times 10^4$ | 0.4 | 50 | ○ |
| Example 16 | 1.0 | 85 | $8 \times 10^5$ | 0.6 | 55 | Δ |
| Example 17 | 20 | 40 | $4 \times 10^3$ | 0.3 | 40 | Δ |
| Comp. Example 7 | 0.01 | 98 | $3 \times 10^6$ | 0.8 | 80 | × |
| Comp. Example 8 | 3.0 | 10 | $4 \times 10^2$ | 0.3 | 40 | × |
| Comp. Example 9 | 0.1 | 90 | $3 \times 10^7$ | 0.8 | 80 | × |
| Comp. Example 10 | 30 | 10 | $2 \times 10^3$ | 0.3 | 40 | × |

Note: The photosensitive characteristic were measured by effecting exposure from outside the photosensitive member.

EXAMPLE 18

A cylinder of Pyrex glass having a diameter of 35 mm and a length of 300 mm was used as a transparent substrate. A 1% solution was prepared by dissolving polyaniline (molecular weight: 40,000) synthesized by chemical oxidation polymerization in N-methyl-2-pyrrolidone. This solution was coated onto the substrate by a vertical immersion method. The dryer shown in FIG. 1 was used, and the holders were quickly fitted to the dryer and were connected to the rotary driving device so as to apply a rotation of 900 rpm. At the same time, the substrate was heated by a 500 W infrared lamp positioned in a distance of 10 cm from the substrate surface and the lamp was adjusted so that the substrate surface reached 100° C. Ten minutes later, the conductive polymer solution on the substrate surface was dry, and a conductive polymer layer having a thickness of 0.1 μm was formed. The error in the film thickness of the conductive polymer layer was below 3% throughout the substrate and a uniform conductive film could be formed.

EXAMPLE 19

A polycarbonate cylinder having a diameter of 35 mm and a length of 300 mm was used as a transparent substrate. A 1% solution was prepared by dissolving polyaniline (molecular weight: 40,000), synthesized by chemical oxidation polymerization, in N-methyl-2-pyrrolidone. This solution was coated onto the substrate by the vertical immersion method. The apparatus shown in FIG. 2 was used, and the holders were quickly fitted to the apparatus, and was connected to the rotary driving device so as to apply rotation of 900 rpm. At the same time, heating of the substrate was started by a 200 W natural convection type heater disposed at a distance of 3 cm from the substrate surface so as to encompass the substrate, and the heater was adjusted so that the substrate surface reached 100° C. Ten minutes later, the conductive polymer solution on the substrate surface was dry, and a conductive polymer layer having a thickness of 0.1 μm was formed. The error in the film thickness of the conductive polymer layer was below 3% throughout the substrate, and a uniform conductive film could be formed.

COMPARATIVE EXAMPLE 11

The same substrate and the same conductive polymer solution as those used in Example 18 were used. After the solution was coated to the substrate, it was naturally dried. The error of the conductive polymer film obtained after 20 minutes was as high as 50%, and only a non-uniform film could be formed.

When the conductor layer on the substrate surface of the electrophotographic sensitive member is formed, the present invention uses a soluble conductive material as a solvent as described above, and can easily form the conductor layer. Accordingly, the present invention can obtain more easily and more economically the conductor layer than the use of conventional materials, and greatly contributes to the reduction of size and cost of an electrophotographic recording apparatus.

We claim:

1. A photosensitive member comprising:

a transparent substrate having a first surface and a second surface opposite to said first surface;

a transparent conductor layer formed on said first surface of said transparent substrate, said transparent conductor layer containing $SnO_2$ formed by thermally decomposing a dried solution of an organotin compound; and a photosensitive layer formed on said conductor layer;

wherein said transparent conductor layer has a thickness which enables exposure of said photosensitive layer through said second surface of said transparent substrate to form an electrostatic latent image on said photosensitive member.

2. A photosensitive member comprising:

a transparent substrate having a first surface and a second surface opposite to said first surface;

a transparent conductor layer formed on said first surface of said transparent substrate, said transparent conductor layer containing a dried solution of a conductive polymer of a polyaniline or its derivative; and a photosensitive layer formed on said transparent conductor layer;

wherein said transparent conductor layer has a thickness which enables exposure of said photosensitive layer through said second surface of said transparent substrate to form an electrostatic latent image on said photosensitive member.

3. A process for producing a photosensitive member on a transparent substrate having first and second surfaces, the second surface being opposite the first surface, the process comprising the steps of:

coating a transparent conductive liquid onto the first surface of said transparent substrate by immersing said transparent substrate into said transparent conductive liquid, said transparent conductive liquid containing a conductive polymer of a polyaniline or its derivative;

drying the coated transparent substrate to form a transparent conductor layer on said first surface of said transparent substrate; and then forming a photosensitive layer on said transparent conductor layer;

wherein said transparent conductor liquid has a thickness which enables, after said drying, exposure of said photosensitive layer through said second surface of said transparent substrate to form an electrostatic latent image on said photosensitive member.

4. A process according to claim 3, further comprising a step of:

immersing the dried transparent substrate into a solution containing a dopant to form said transparent conductor layer as a doped transparent conductor layer before forming said photosensitive layer on said transparent conductor layer.

5. A process for producing a photosensitive member on a transparent substrate having first and second surfaces, the second surface being opposite the first surface, the process comprising the steps of:

coating a solution of an organotin compound onto said first surface of said transparent substrate by immersing said transparent substrate into said solution of an organotin compound;

drying said solution of an organotin compound to form a transparent conductor layer of $SnO_2$ on said first surface of said transparent substrate;

wherein said transparent conductor layer of $SnO_2$ has a thickness which enables exposure of said photosensitive layer through said second surface of said transparent substrate to form an electrostatic latent image on the photosensitive member.

6. A process according to claim 3, wherein said coating comprises:

immersing said transparent substrate into a mixed solution of a first solution containing a soluble conductive polymer and a second solution containing a dopant.

7. A process according to claim 3, further comprising:

doping said transparent conductor layer by using a gas of a dopant after said drying and before said forming of said photosensitive layer.

8. A process according to claim 4, wherein said soluble conductive polymer comprises one of polyaniline or its derivative, a polypyrrole derivative or a polythiophene derivative.

9. A photosensitive member comprising:

a transparent substrate having a first surface and a second surface opposite said first surface;

a transparent conductor layer comprising a dried solution of a conductive polymer on said first surface of said transparent substrate; and a photosensitive layer formed on said transparent conductor layer;

wherein said transparent conductor layer has a thickness which enables exposure of said photosensitive layer through said second surface of said transparent substrate to form an electrostatic latent image on said photosensitive member and which improves the transparency of said transparent conductor layer, and wherein said transparent conductor layer includes a dopant for improving its conductivity.

10. A photosensitive member according to claim 9, wherein said conductive polymer is selected from the group consisting of polyaniline or its derivative, a polypyrrole derivative, and a polythiophene derivative.

11. A process for producing a photosensitive member, comprising the steps of:

immersing a transparent substrate having a first surface and a second surface opposite to said first surface into a solution of a soluble conductive polymer to form an undoped transparent conductor layer on said transparent substrate;

drying the coated undoped transparent substrate; and then subjecting the dried, coated undoped transparent substrate to a doping treatment, using a dopant, thereby to form a doped, transparent conductor layer having increased transparency than and being thinner than an undoped transparent conductor layer;

wherein said doped transparent conductor layer has a thickness which enables exposure of a photosensitive layer through said second surface of said transparent substrate to form an electrostatic latent image on said photosensitive member; and, then, forming a photosensitive layer on said doped, transparent conductor layer.

12. A process according to claim 11, wherein said doping step is performed using a gas of a dopant material.

13. A process according to claim 11, wherein said doping step is performed using a solution containing a dopant.

14. A process according to claim 11, wherein said photosensitive layer is formed by immersion of the transparent substrate, as coated with the conductor layer and dried, into a solution of constituent materials of the photosensitive layer.

15. An electrophotographic recording apparatus, comprising:

a photosensitive member comprising:

a transparent substrate having a first surface and a second surface opposite to said first surface;

a transparent conductor layer formed on said first surface of said transparent substrate, said transparent conductor layer containing a dried solution of a conductive polymer of a polyaniline or its derivative; and a photosensitive layer formed on said transparent conductor layer;

wherein said transparent conductor layer has a thickness which enables exposure of said photosensitive layer through said second surface of said transparent substrate to form an electrostatic latent image on said photosensitive member;

voltage application means for uniformly electrically charging the exposed surface of said photosensitive member;

exposure means for effecting an exposure onto the back surface of said photosensitive member and thereby forming an electrostatic latent image on the exposed surface of said photosensitive member;

development means for developing said electrostatic latent image to form a toner image; and transfer means for transferring said toner image to recording paper.

16. An electrophotographic recording apparatus including a photosensitive member comprising:

a transparent substrate having a first surface and a second surface opposite to said first surface;

a transparent conductor layer formed on said first surface of said transparent substrate, said transparent conductor layer containing $SnO_2$ formed by thermally decomposing a dried solution of an organotin compound; and a photosensitive layer formed on said transparent conductor layer;

wherein said transparent conductor layer has a thickness which enables exposure of said photosensitive layer through said second surface of said transparent substrate to form an electrostatic latent image on said photosensitive member;

voltage application means for uniformly electrically charging the exposed surface of said photosensitive member;

exposure means for effecting an exposure onto the back surface of said photosensitive member and forming an electrostatic latent image on the exposed surface of said photosensitive member;

development means for developing said electrostatic latent image to form a toner image; and transfer means for transferring said toner image to recording paper.

17. A photosensitive member according to claim 1, wherein said transparent conductor layer further contains a dopant which improves a conductivity of said transparent conductor layer.

18. A photosensitive member according to claim 2, wherein said transparent conductor layer further contains a dopant which improves a conductivity of said transparent conductive layer.

19. A process according to claim 11, wherein said soluble conductive polymer is selected from the group consisting of a polyaniline or its derivative, a polypyrrole derivative, and a polythiophene derivative.

* * * * *

UNITED STATES PATENT AND TRADEMARK OFFICE

CERTIFICATE OF CORRECTION

PATENT NO. : 5,616,440

DATED : Apr. 1, 1997

INVENTOR(S) : TAKAHASHI et al.

It is certified that error appears in the above-indentified patent and that said Letters Patent is hereby corrected as shown below:

TITLE PAGE: [73] Assignee: Replace with the following: --Fujitsu Limited, Kawasaki, Japan--.

Col. 2, line 67, change "$SnP_2$" to --$SnO_2$--.

Col. 3, line 46, after "method" insert --of--.

Col. 5, line 38, change "the-soluble" to --the soluble--;
line 54, delete "to".

Col. 11, line 7, delete "a".

Col. 15, line 24, change "trichloroethan" to --trichloroethane--.

Col. 17, TABLE 3, in the transmissivity (%) column, third line, change "30" to --50--.

Col. 19, line 30 (Claim 3, line 14), change "layer;" to --layer,--.

Signed and Sealed this

Eighth Day of July, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,616,440

DATED : Apr. 1, 1997

INVENTOR(S) : Takahashi, et al.

It is certified that error appears in the above-indentified patent and that said Letters Patent is hereby corrected as shown below:

Title page, item [73] Assignee: Replace with the following:
--Fujitsu Limited, Kawasaki, Japan--.

Signed and Sealed this

Seventh Day of October, 1997

Bruce Lehman

*Attest:*

BRUCE LEHMAN

*Attesting Officer*

*Commissioner of Patents and Trademarks*